US005757732A

United States Patent [19]

Kuo

[11] Patent Number: 5,757,732

[45] Date of Patent: May 26, 1998

[54] ALARM CLOCK HAVING ON-OFF SWITCH TIMER

[76] Inventor: Chu-Rong Kuo, 12F, No. 367, Han Kou Road, Sec. 4, Taichung, Taiwan

[21] Appl. No.: 758,573

[22] Filed: Dec. 3, 1996

[51] Int. Cl.[6] ..... G04B 23/02

[52] U.S. Cl. ..... 368/262; 368/72

[58] Field of Search ..... 368/72–74, 250, 368/254, 262–269, 243, 244

[56] References Cited

U.S. PATENT DOCUMENTS

| | | | |
|---|---|---|---|
| 2,361,128 | 10/1944 | Schlenker | 368/262 |
| 3,604,200 | 9/1971 | Sapper | 368/262 |
| 4,747,087 | 5/1988 | Sakuma | 368/262 |
| 5,095,468 | 3/1992 | Sato | 368/72 |
| 5,568,452 | 10/1996 | Kronenberg | 368/262 |

*Primary Examiner*—Bernard Roskoski
*Attorney, Agent, or Firm*—Browdy and Neimark

[57] ABSTRACT

An alarm clock comprises a housing seat, an upper body and a side body. The housing seat is provided therein with an alarm clock main body, a gear box, and a circuit member. The upper body is joined with the housing seat such that a pull rod of the upper body is engaged with a retaining hook contained in the gear box. The retaining hook is urged by a cam driven by a motor of the gear box. The side body is fastened pivotally at one end thereof with the upper body and is provided at another end thereof with a retainer urging a positive piece located in the housing seat. After the buzzing effect of the alarm clock is brough about, the retaining hook is actuated by the cam to move away from the pull rod, thereby enabling the retrieving force of a compression spring, which is fitted over the pull rod, to cause the ejection of the upper body and the side body so as to bring about the dynamic effect of the alarm clock.

4 Claims, 6 Drawing Sheets

ALARM CLOCK HAVING ON-OFF SWITCH TIMER

FIELD OF THE INVENTION

The present invention relates generally to an alarm clock, and more particularly to an alarm clock having a dynamic effect.

BACKGROUND OF THE INVENTION

The conventional alarm clock is generally provided with a spring for actuating the rammer at a specific time to strike continuously a metal bell to produce sound so as to wake up a person asleep or to remind a person of an appointment or something that is to be done at a specific time. Such conventional alarm clock is generally large in size, and the sound it produces is rather monotonous at best.

The improved alarm clock of electronic type is provided with a quartz oscillator to enhance the precision of the alarm clock and is further provided in the periphery of the housing thereof with an elastic press switch for controlling the buzzing effect of the alarm clock. Such an electronic alarm clock as described above is still devoid of charm.

In order to enhance the charm of an alarm clock, certain makers introduced alarm clocks which are provided with a toy animal, a doll, a merry-go-round, or a toy bicycle, etc., which is mounted on the alarm clock such that it is mechanically linked with the alarming mechanism of the alarm clock so as to bring about a series of motions in concert with the buzzing of the alarm clock. However, there is still room for improvement in such a conventional alarm clock as described above.

SUMMARY OF THE INVENTION

It is therefore the primary objective of the present invention to provide an alarm clock having a dynamic effect to attract the interest of the consumers.

It is another objective of the present invention to provide an alarm clock with a better means to wake up a person asleep.

In keeping with the principle of the present invention, the foregoing objectives of the present invention are attained by an alarm clock, which comprises a housing seat, an upper body and a side body. The housing seat is provided therein with a main body of the alarm clock, a gear box, and a circuit member. The upper body is joined with the housing seat such that a pull rod of the upper body is engaged with a retaining hook contained in the gear box. The retaining hook is urged by a cam driven by a motor. The side body is fastened pivotally at one end thereof with the upper body and is provided at another end thereof with a retainer urging a positive piece located in the housing seat. After the buzzing effect of the alarm clock is brought about, the retaining hook is actuated by the cam to move away from the pull rod, thereby enabling the retrieving force of a compression spring, which is fitted over the pull rod, to cause the ejection of the upper body and the side body so as to bring about the dynamic effect of the alarm clock of the present invention.

The foregoing objectives, features and functions of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
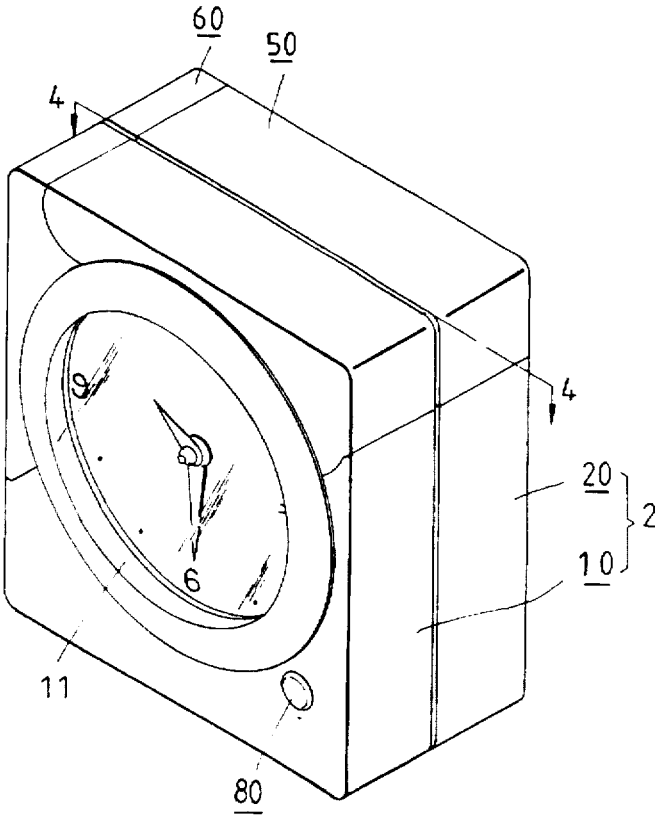
FIG. 1 shows a perspective schematic view of an alarm clock embodied in the present invention.
Figure 2:
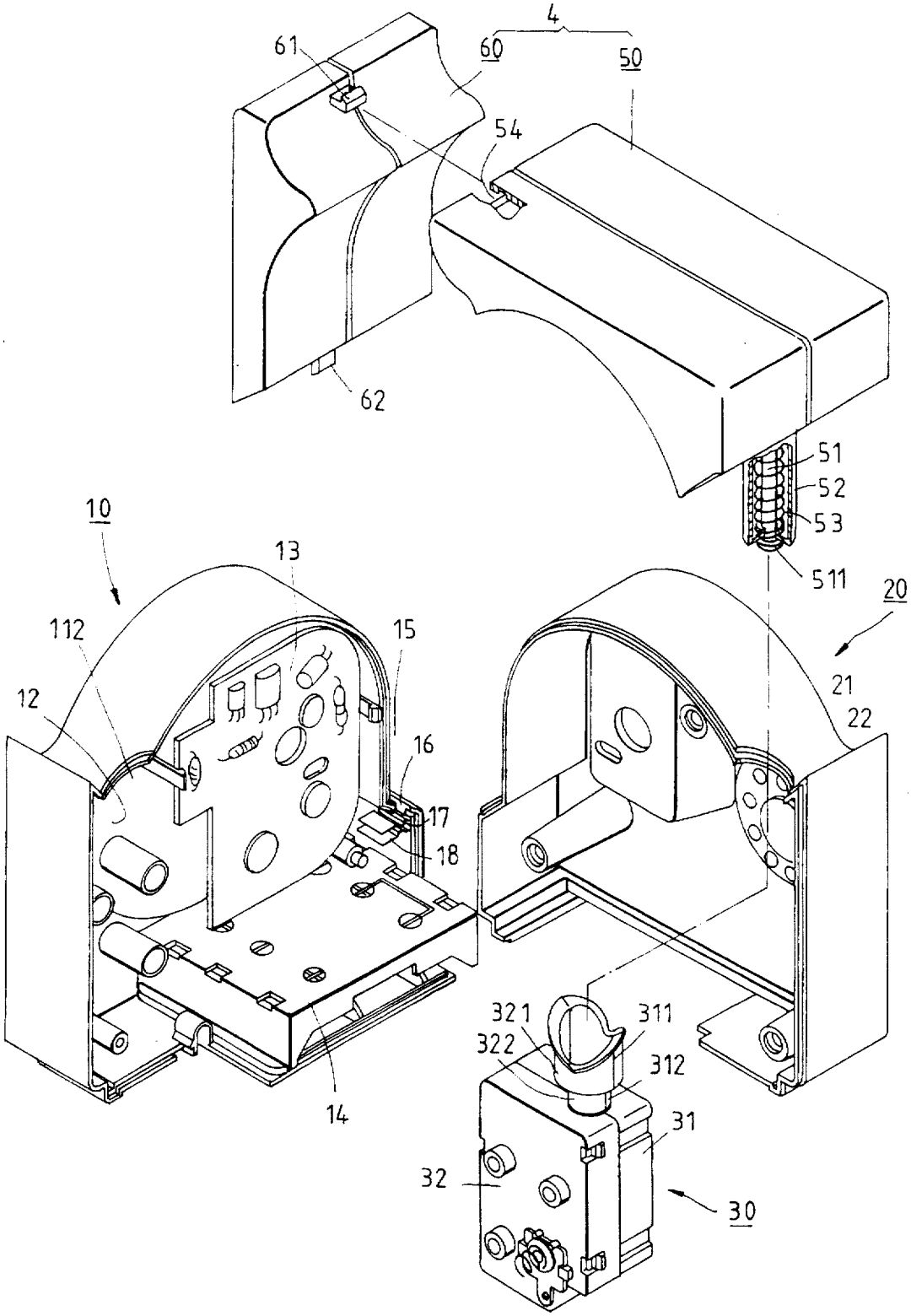
FIG. 2 shows an exploded view of the alarm clock of the present invention as shown in FIG. 1.

As shown in FIGS. 1 and 2, an alarm clock of the preferred embodiment of the present invention comprises a housing seat 2 and an ON-OFF device 4.

The housing seat 2 is composed of a front housing 10 and a rear housing 20. The front side of the front housing 10 serves as a clock face 11. The front housing 10 is provided in the rear side thereof with a receiving cell 12 for receiving the alarm clock main body (not shown in the drawings) and a PCB base board 13. The front housing 10 is further provided at the bottom thereof with a battery seat 14 for mounting the batteries. The front housing 10 has an arcuate top, a semicircular cut 112 adjacent to the receiving cell 12, and a recessed portion 15. The recessed portion 15 is provided at the bottom side thereof with a retaining slot 16 under which a positive piece 17 and a negative 18 are located. The rear housing 20 is joined with the front housing 10 in a complementary manner and is provided in the top thereof with a cut 21 corresponding in location to the cut 112 of the front housing 10. A loudspeaker 22 is fastened with the wall of the rear housing 20 such that the loudspeaker 22 is regulated by the PCB base board 13 to bring about the buzzing of the alarm clock.

The ON-OFF device 4 comprises a gear box 30, an upper body 50, and a side body 60.

Figure 4:
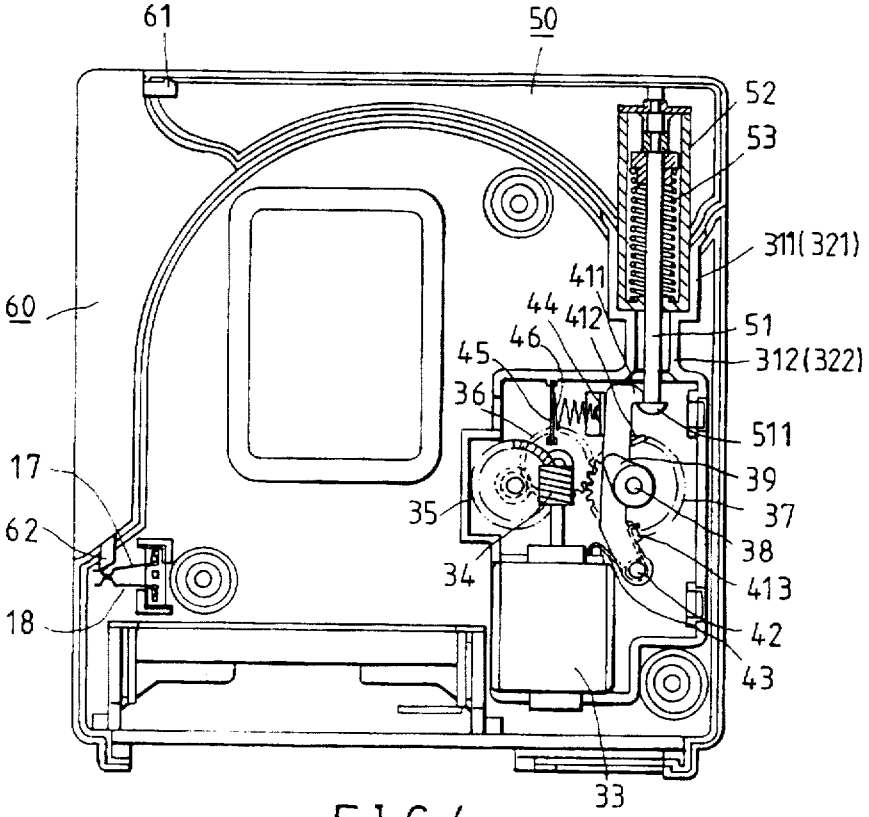
FIG. 4 shows a sectional view taken in the direction indicated by a line 4—4 as shown in FIG. 1.
Figure 3:
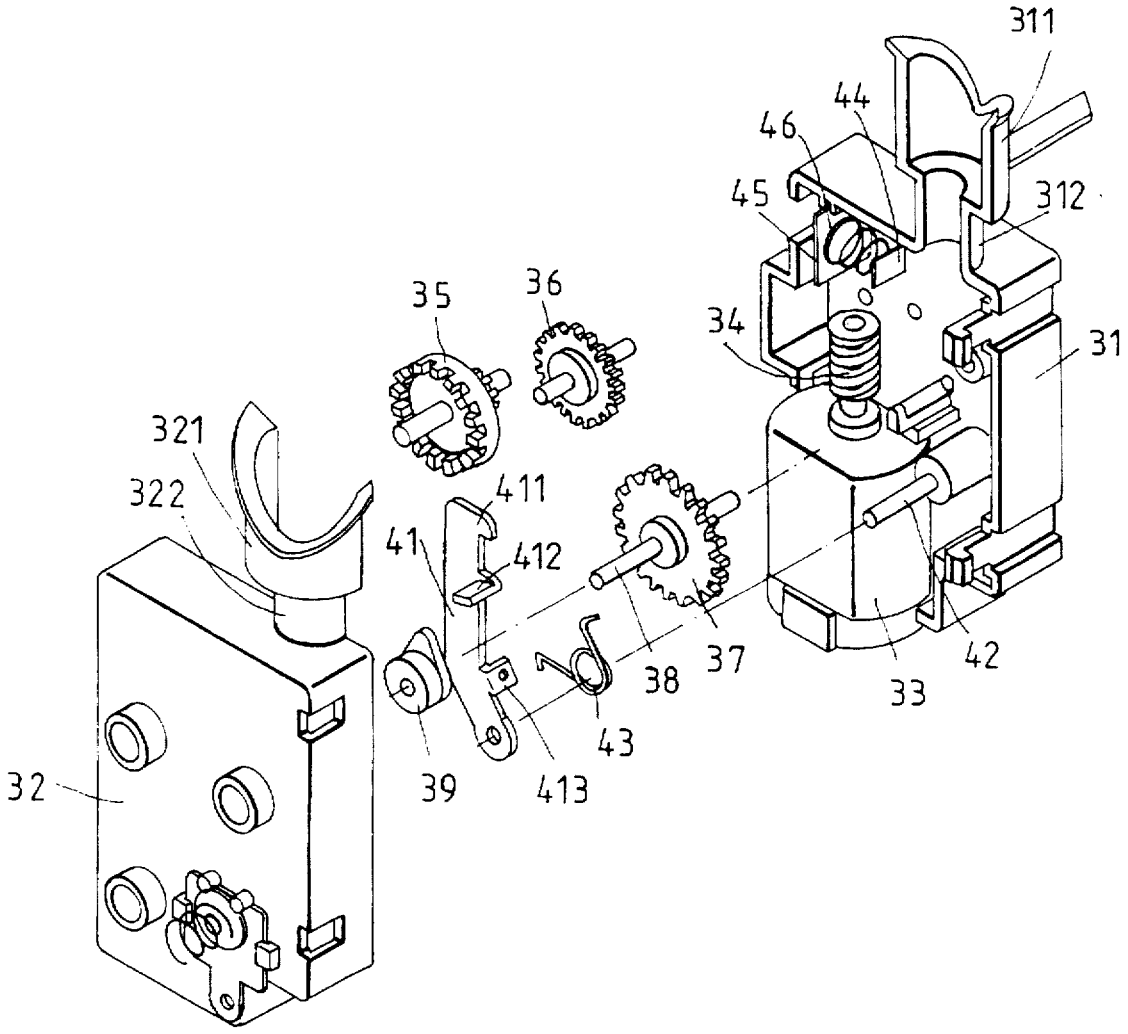
FIG. 3 shows an exploded view of a gear box of the alarm clock as shown in FIG. 2.

The gear box 30 is mounted in the housing seat 2 and is composed of a front cover 31 and a rear cover 32, which are square in shape and are joined together. The front cover 31 is provided with a semi-cylindrical connection portion 311 extending upwards from the top thereof, whereas the rear cover 32 is similarly provided with a semi-cylindrical connection portion 321 extending upwards from the top thereof. The connection portion 311 is provided in the midsegment thereof with a neck 312 smaller in radius than the connection portion 311. Similarly, the connection portion 321 is provided in the midsegment thereof with a neck 322 smaller in radius than the connection portion 321. The axes of the necks 312 and 322 are respectively in communication with the interiors of the front cover 31 and the rear cover 32 of the gear box 30. A motor 33 is housed by the front cover 31 and the rear cover 32, as shown in FIGS. 3 and 4. The motor 33 is provided at one end thereof with a worm rod 34 fastened therewith for actuating a crown gear 35 which is in turn provided at one end thereof with an elliptical wheel 36 for linking a driven gear 37. The driven gear 37 has a center shaft 38 which is provided with a cam 39 fastened therewith. A curved retaining hook 41 is fastened pivotally with a spindle 42 of the front cover 31 and is provided with a retaining portion 411, a stopping portion 412 and a hooked portion 413. The stopping portion 412 serves to cause the retaining hook 41 to swing towards one side at such time when the cam 39 is actuated to turn. The hooked portion 413 is intended to engage a torsion spring 43 for causing the retaining hook 41 to return to its original position at such time when the stopping portion 412 is no longer pressed against by the cam 39. The front cover 31 of the gear box 30 is further provided with a conductive elastic piece 44 which is always in contact with the retaining hook 41 and is provided with an electrode piece 45 and a compression spring 46.

The upper body 50 has a bottom which is complementary in profile with the top of the housing seat 2. The upper body 50 is provided with a pull rod 51 fastened therewith such that the pull rod 51 is opposite in location to the cut 112 of the front housing 10 and the cut 21 of the rear housing 20. The pull rod 51 is provided at the bottom end thereof with a hooked portion 511 greater in diameter than the pull rod 51. Located between the head of the pull rod 51 and the hooked portion 511 of the pull rod 51 is a cylindrical sleeve 52. A compression spring 53 is located between the inner wall of the sleeve 52 and the periphery of the pull rod 51 for actuating the sleeve 52 to move along the axial direction of the pull rod 51 when the sleeve 52 is exerted on by the force or when the compression spring 53 returns to its original position. The upper body 50 is provided with a retaining slot 54 opposite in location to one side of the pull rod 51.

The side body 60 is engaged complementarily with the recessed portion 15 of the housing seat 2 and the upper body 50 and is provided with a retaining protuberance 61 which is engaged with the retaining slot 54 of the upper body 50, and with a retaining block 62 which urges the positive piece 17 located in the retaining slot 16 of the front housing 10.

The gear box 30 is formed of the front cover 31 and the rear cover 32, in which the motor 33, the crown gear 35, the elliptical wheel 36, the cam 39, the retaining hook 41, the spring 43, and so forth are housed. The gear box 30 is fastened with the housing seat 2 by a plurality of screws (not shown in the drawings) such that the gear box 30 is opposite in location to one side of the PCB base board 13. The pull rod 51 and the sleeve 52 of the upper body 50 are located in the housing seat 2 via the cuts 112 and 21 of the front housing 10 and the rear housing 20 such that the necks 312 and 322 of the gear box 30 are pressed against by the bottom edge of the sleeve 52, which is then forced downwards such that the hooked portion 511 of the pull rod 51 is engaged with the retaining portion 411 of the retaining hook 41. As a result, the upper body 50 is fastened securely with the top edge of the housing seat 2. The conductive elastic piece 44 is caused by the retaining hook 41 to swing to press against the spring 46. Finally, the retaining protuberance 61 of the side body 60 is engaged with the retaining slot 54 of the upper body 50. In the meantime, the retaining block 62 of the side body 60 is engaged with the retaining slot 16 of the housing seat 2.

Figure 5:
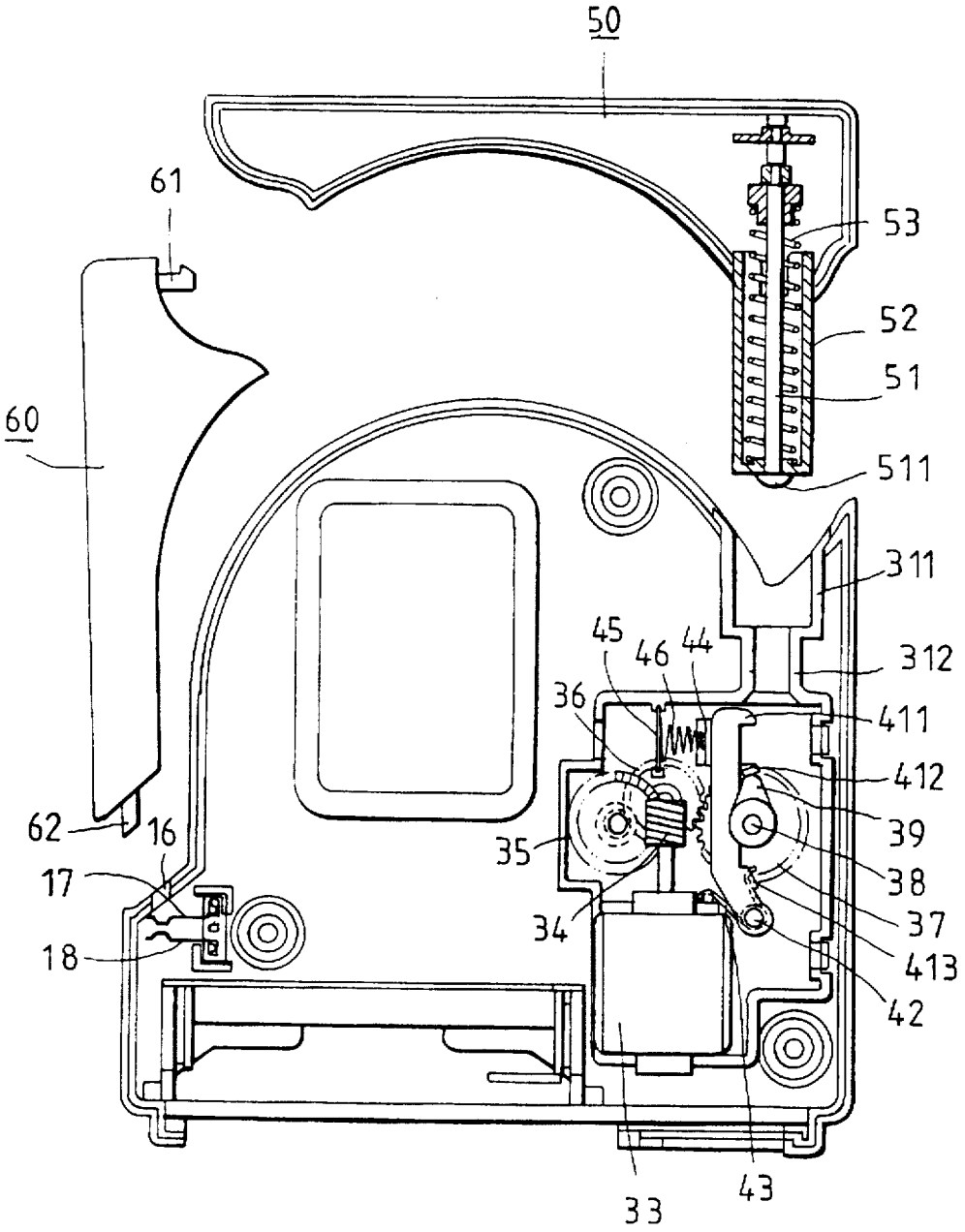
FIG. 5 is a schematic view showing the ejection of the upper body and the side body of the alarm clock of the present invention.
Figure 6:
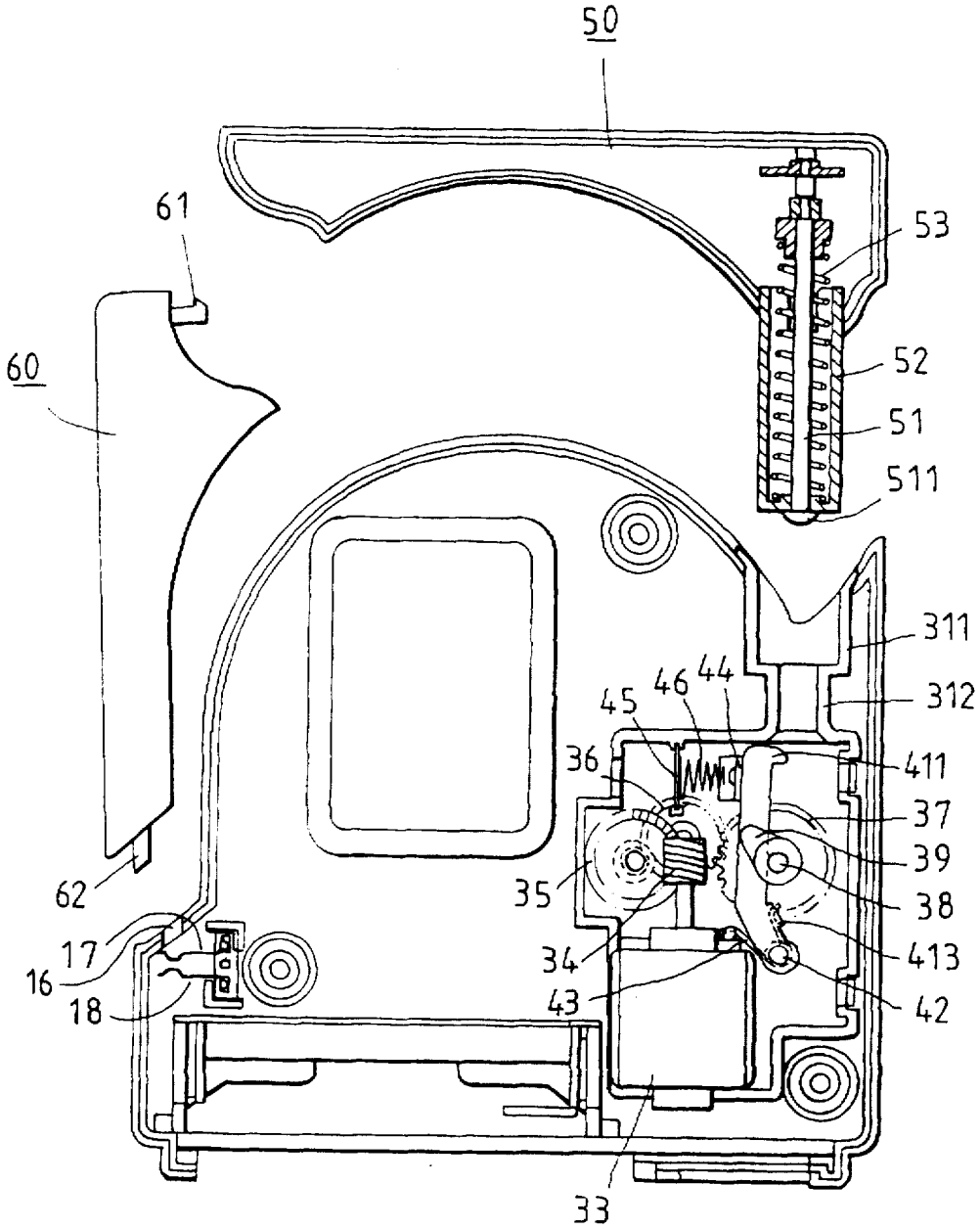
FIG. 6 shows a schematic view of the gear box at work according to the present invention.
Figure 7:
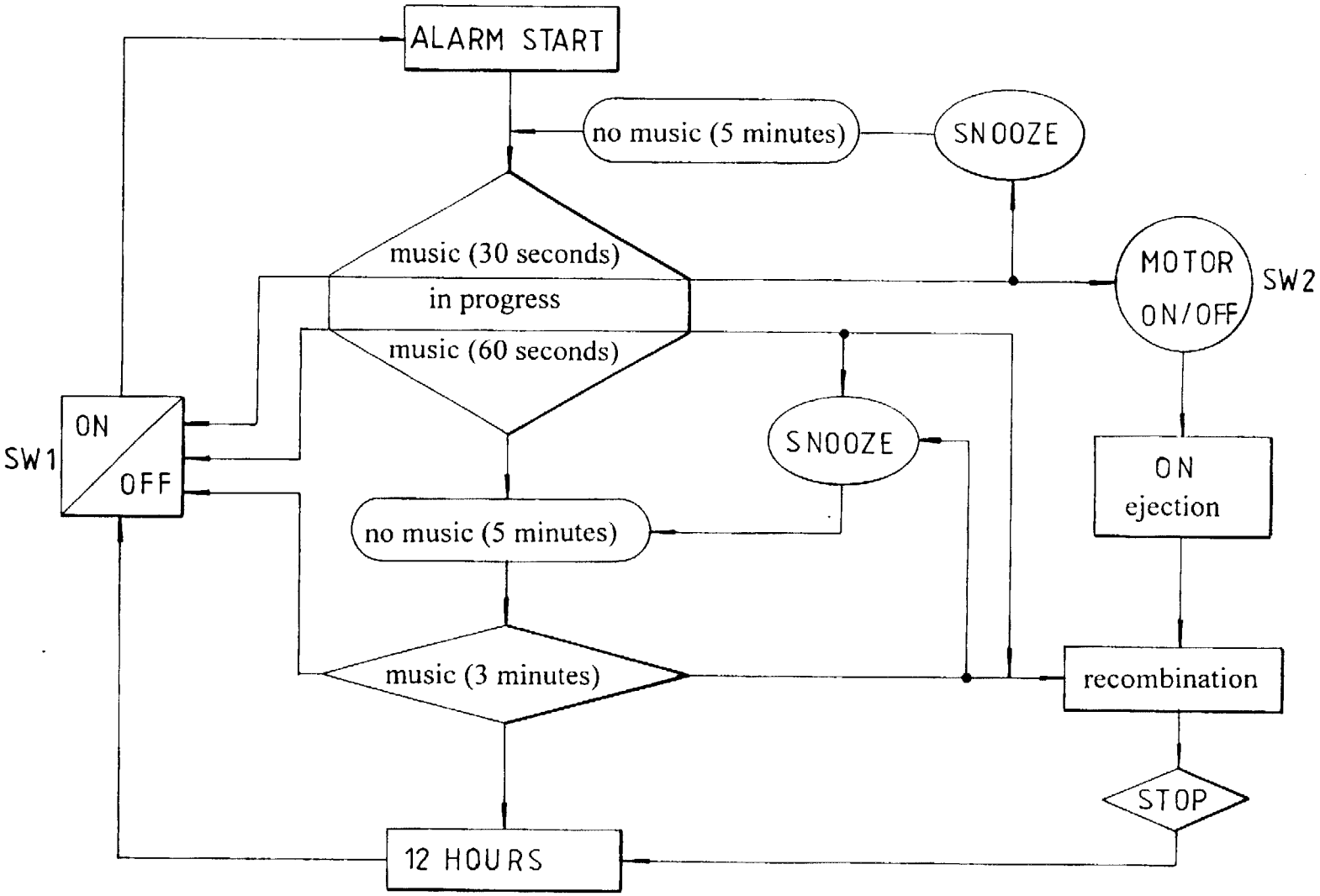
FIG. 7 shows a flow diagram of the alarming effect of the alarm clock of the present invention.

In operation, the electronic wiring of the PCB base board 13 is activated at a set time such that the buzzing is brought about by the loudspeaker 21 of the rear housing 20. In 30 seconds, the motor 33 of the gear box 30 is started by a signal so as to drive the crown gear 35, the elliptical wheel 36 and the driven gear 37 via the worm wheel 34. As a result, the cam 39, which is mounted on the shaft 38 of the driven gear 37, is actuated to rotate in a counterclockwise direction so as to urge the stopping portion 412 of the retaining hook 41. The retaining hook 41 is thus caused by the radial thrust of the cam 39 to move in the same direction until such time when the retaining portion 411 of the retaining hook 41 is no longer able to retain the hooked portion 511 of the pull rod 51 of the upper body 50. As a result, the force of the compressed spring 53 of the sleeve 52 works to eject the upper body 50 and the side body 60, as shown in FIG. 5. In the meantime, the retaining hook 41 is still urged by the cam 39. As soon as the cam 39 moves away from the stopping portion 412 of the retaining hook 41, the retaining hook 41 is forced by the torsion spring 43 to return to its original position. Without being urged by the retaining hook 41, the elastic piece 44 is able to return to its original position such that the spring 46 is no longer urged by the elastic piece 44, thereby resulting in the power interruption which causes the motor 33 to stop. As a result, the cam 39 is stopped such that the cam 39 is located at a position similar to the position in FIG. 4, as shown in FIG. 6. The buzzing of the alarm clock goes on until such time when the ejected upper body 50 and the ejected side 60 are joined again with the housing seat 2, as shown in FIG. 4. In other words, the buzzing is stopped when the retaining block 62 of the side body 60 urges the positive piece 17 of the housing seat 2 to make contact with the negative piece 18*s* so as to cause the elastic piece 44 to press against the spring 46 once again.

The present invention is characterized in that the upper body 50 and the side body 60 are ejected after the buzzing has lasted a predetermined period of time. The buzzing goes on after the ejection of the upper body 50 and the side body 60. The way to stop the buzzing is to rejoin the ejected upper body 50 and the ejected side body 60 with the housing seat 2. The alarm clock of the present invention is therefore very effective in awakening a person.

Another feature of the present invention is that the power supply is interrupted as soon as the retaining hook 41 is no longer pressed against by the cam 39 of the gear box 30. As a result, when the alarm clock is started again, the cam 39 is actuated from its initial point such that the maximum rotational torsion is attained to enable the cam 39 to urge the retaining hook 41 smoothly.

The present invention may be provided in the clock face 11 of the housing seat 2 with a snooze button 80, as shown in FIG. 1. The snooze button 80 is intended to allow a person to have a quiet period of a desired duration after the onset of the buzzing but before the activation of the motor 33 of the gear box 30. Such a function as described above is brought about by pressing the snooze button 80. Upon the lapse of the quiet period, the buzzing resumes automatically.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An alarm clock comprising a housing seat, in which an alarm clock main body, a battery set, a control circuit board and a loudspeaker are disposed; wherein said housing seat is provided in a top thereof with a cut, and in one side thereof with a retaining slot having in a bottom thereof a positive piece and a negative piece separated from said positive piece at an interval, said housing seat further provided therein with a gear box having a connection portion corresponding in location to said cut of said housing seat, said connection portion having at a midsegment thereof a neck smaller in diameter than said connection portion, said gear box further having therein a retaining hook fastened pivotally therewith and provided with a retaining portion, a stopping portion, and, a hooked portion engageable with a torsion spring, said gear box still further having therein a motor, a plurality of linking gears driven by said motor, and a cam driven by said motor via said linking gears such that said cam is capable of pressing against said stopping portion of said retaining hook, said housing seat still further provided with an upper body fastened detachably therewith, said upper body provided with a pull rod opposite in location to said cut of said housing seat, said pull rod having at one end thereof a hooked portion, said pull rod provided with a sleeve fitted thereover such that said sleeve can slide along an axial direction of said pull rod, said pull rod further provided with a compression spring fitted thereover such that said compression spring is located between an inner wall of said sleeve and a periphery of said pull rod, said upper body being fastened detachably with said housing seat such that said neck of said gear box is pressed against by said sleeve and that said hooked portion of said pull rod is engaged with said retaining portion of said retaining hook, said housing seat still further provided with a side body fastened detachably therewith such that one side of said side body is fastened pivotally with said upper body, and that another side of said side body is provided with a retaining block urging said positive piece of said housing seat and contacting said negative piece of said housing seat; wherein said loudspeaker is activated to produce a buzzing for a predetermined duration after said cam of said gear box is actuated by said motor; and wherein said upper body and said side body are ejected from said housing seat at such time when said retaining hook is urged by said cam in motion to cause said retaining portion of said retaining hook to move away from said hooked portion of said pull rod.

2. The alarm clock as defined in claim 1, wherein said housing seat is formed of a front housing and a rear housing.

3. The alarm clock as defined in claim 1, wherein said gear box is formed of a front cover and a rear cover.

4. The alarm clock as defined in claim 1, wherein said housing seat is provided with a snooze button capable of delaying the operation of said motor of said gear box.

* * * * *